US006391250B1

(12) United States Patent
Wolfsgruber et al.

(10) Patent No.: US 6,391,250 B1
(45) Date of Patent: May 21, 2002

(54) METHOD FOR PRODUCING FORMS AND FOAMED METAL FORMS

(75) Inventors: Eric Wolfsgruber, Braunau am Inn; Helmut Wörz, Brixlegg, both of (AT); Frantisèk Simanĉik, Bratislava (SK)

(73) Assignee: Mepura Metallpulvergesellschaft mbH Ranshofen (AT)

( * ) Notice: Subject to any disclaimer, the term of this patent is extended or adjusted under 35 U.S.C. 154(b) by 0 days.

(21) Appl. No.: 09/647,411

(22) PCT Filed: Apr. 9, 1999

(86) PCT No.: PCT/AT99/00091

§ 371 Date: Nov. 30, 2000

§ 102(e) Date: Nov. 30, 2000

(87) PCT Pub. No.: WO99/52661

PCT Pub. Date: Oct. 21, 1999

(30) Foreign Application Priority Data

Apr. 9, 1998 (AT) ..... A 625/98

(51) Int. Cl.[7] ..... B22F 3/10
(52) U.S. Cl. ..... 419/2
(58) Field of Search ..... 419/2

(56) References Cited

U.S. PATENT DOCUMENTS

| | | | | |
|---|---|---|---|---|
| 5,151,246 A | | 9/1992 | Baumeister et al. | |
| 5,393,485 A | * | 2/1995 | Worz et al. | 419/41 |
| 5,865,237 A | * | 2/1999 | Schorghuber et al. | 164/79 |

FOREIGN PATENT DOCUMENTS

| | | |
|---|---|---|
| DE | 4124591 | 2/1993 |
| DE | 19612781 | 8/1997 |
| EP | 0744586 | 11/1996 |

* cited by examiner

*Primary Examiner*—Daniel J. Jenkins
(74) *Attorney, Agent, or Firm*—Bachman & LaPointe, P.C.

(57) ABSTRACT

The invention relates to the production of forms or similar from foamed metal based on aluminum or other metals. Semi-finished product bodies or similar consisting of a foamable semi-finished product material obtained by compacting a mixture of at least one matrix metal powder and at least one expanding agent which releases a foaming gas are placed into a foaming mould or similar where they are geometrically arranged in the desired manner and then heated to a temperature in the range of melting temperature of the matrix metal. Once the mould has been filled, the foaming process is concluded and the resulting foamed metal forms are shaped out. The invention is characterized in that at least one foamable compacted semi-finished product body is placed into a foaming mould together with at least one structure or functional part or similar consisting of a material which does not foam at the melting temperature of the matrix metal, retained in a desired position and then heated whereby metal foam is produced, said metal foam contact-binding or surrounding the structure or functional part in the form corresponding to the inner cavity of the mould. The metal of the metal foam formed is fully or partially brought into contact with the structure or functional part and after cooling, the composite form obtained is removed form the mould with the structure or functional part bonded in the metal foam.

2 Claims, 1 Drawing Sheet

METHOD FOR PRODUCING FORMS AND FOAMED METAL FORMS

The present invention relates generally to novel foamed metal moldings, and in particular to a novel process for the specific and reproducible production of these novel moldings.

In recent years a large number of publications and patents have been issued concerning the production of foamed metals, devices for carrying out the process and also concerning the metal/foaming agent mixtures required for foamed metal production or the semifinished products for use in a metal foaming production process and concerning the production of said semifinished product.

Reference is made only by way of example and by no means exhaustively to the following documents with regard to the proposals and activities which have become known in this area.

DE 1 164 102 A, DE 196 12 781 C1, DE 43 40 791A1, DE 44 26 627 A1, EP 460 392 A1, EP588 182A2.

Reference is also to be made here to a known technique of foaming metals, in which semifinished products formed from compacted metal particle/foaming agent particle mixtures are placed in foaming molds, for example of steel, and made to expand by heating.

According to EP 804 982 A2, the powder-metallurgical starting material is heated in a heated chamber outside a foam casting mold and made to expand, after which the metal foam, adjusted in its amount to match the volume capacity of the casting mold, is pressed in its entirety into the casting mold, a relatively complex technique.

In U.S. Pat. No. 3,087,807 A there is a description of a process according to which a semifinished product, formed to correspond approximately in its shape to the desired final form of the finished foamed metal body, is introduced into a hollow enclosure and expanded there by heating.

DE 44 24 15 A1 describes foamed metals with anisotropic properties, which are produced by heating the foamable semifinished product in the foaming and casting mold and subsequent deformation. It is stated there that, for destroying the walls between the pores for the purpose of further reducing their number, said walls representing the means by which the electrical and thermal conduction of the foamed metal, in itself reduced by the pores, takes place, it is possible to provide for the integration of small ceramic or hard-metal particles, short fibers or the like, which serve as crack starters during the deformation.

The number and variability of the application possibilities of foamed metals or of moldings, workpieces, structural elements or the like produced from them is high. Mention is to be made at this point, just as examples, of the stiffening of hollow forms, all structural elements used for sound and vibration damping of the widest variety of types, also structural elements inhibiting energy flows, such as heat flow for example, and not least use as decorative and covering structural elements, increasingly valued on account of their low density, such as for example wall plates and panels or the like, the foam structure itself, or else foam-structure limits within the structural elements, sometimes providing ist surface with attractive esthetic aspects, which may serve for decorative purposes.

In many cases, however, it is a fact that the individual foamed metal molding by itself is not functional and, as for example in the case of soundproofing structural elements, wall panels or the like, requires some sort of securing means or else, for example, is to have cavities, openings or the like, which are intended for example for receiving securing, connecting and/or joining elements.

It is consequently necessary after completion of the foamed metal body to perform finishing work on it, such that the required clearances are made in it, such that, for example, retaining elements have to be screwed into the previously made holes or that clamping and position-retaining elements, for example reaching around the edges of the structural element, have to be attached.

If, for example, foamed metal composite structural elements are to be realized, that is to say for example sandwich structural elements, for example with a lower and upper solid covering metal sheet and a foamed metal structure in between, it has previously been the procedure to introduce a metal powder/foaming-agent powder mixture between the two metal sheets and then produce an essentially compact preform or semifinished body with outer covering layers, for example by rolling, pressing or the like, which body is expanded at elevated temperature, for example in a mold, the bottom sheet then for example remaining in position and the covering sheet being "lifted" into a final position by the expanding foamed metal. A disadvantage of this technology, cited here as an example, is that it allows an exact final positioning of the sheets to be achieved only with difficulty.

The object of the invention is to provide a process in which there is essentially no longer any need, such as that described above, for the subsequent provision of structural elements, retaining elements, cavities, clearances or the like. The novel process should, furthermore, save the use of costly-to-produce pre-material, such as for example the semifinished product as described above, on the basis of a compacted metal powder/foaming agent/covering metal sheet composite and should lead to foamed metal products with integrated-in or integrated-on solid elements with exactly controllable final positioning.

The novel process is finally intended to enable the production of finished foamed metal moldings and structural elements suitable right away for technical operation and use, in essentially a single process step.

The invention consequently relates to a novel process for producing moldings, workpieces or structural elements from or with foamed metal on the basis of aluminum or aluminum alloys or other metals or alloys, in which process semifinished bodies, bars, profiles, plates or the like of foamable semifinished material, obtained by powder-metallurgical means by compacting a mixture of at least one powder of the matrix metal with at least one foaming agent which releases a foaming gas at elevated temperature and is base d on at least one metal hydride or some other foaming agent, are introduced into a foaming and shaping mold or the like, are arranged there in the respectively desired geometrical arrangement and two-dimensional and/or three-dimensional distribution, and are brought to a temperature in the range of the melting temperature of the matrix metal in the said mold by heating, the foaming operation is ended after filling of the cavity of said mold to a desired degree with the foamed metal formed and, finally, the foamed metal moldings, workpieces or structural elements obtained in this way are demolded or removed, characterized therein, that at least one foamable, compacted semifinished body or a plurality of semifinished bodies of this type is/are introduced into the foaming and shaping mold, together with at least one structure or body formed from a material or solid material or metal not foamable at the melting temperature of the matrix metal o r foaming temperature and/or a (technical) functional structural element from the group comprising wires, cables, bars, networks, gratings, foils, plates, sheets, honeycomb bodies, profiles, tubes, bushes, anchoring elements, screw shanks or the like, and is/are held in the desired Position, after which the heating is performed with formation of the foamed metal, enclosing the structure or the (solid) body and/or functional structural element integrally and snugly in the form or shape corresponding to the mold cavity, the material or matrix metal of the foamed metal formed at the respective foaming temperature being brought into contact with the entire structure or (solid) body and/or functional structural element or with a part of the same, and after appropriate cooling, the composite molding or structural element obtained, with a structure firmly bonded in the foamed metal, or firmly bonded (solid) body and/or functional structural element, is demolded.

Consequently, the essence of the invention is not only in particular that the foaming operation serves for the forming of the foamed metal itself but also that the foamed metal which develops bonds in situ and integrally with the solid parts, of whatever specific kind they are. Consequently, subsequent material weaknesses, for example due to making holes, threads or the like for the fastening of functional parts, retaining elements or the like can be avoided and the bonding in and anchorage of the solid parts in the finished foamed metal body is achieved to an optimum extent by their in-situ encapsulation in foam.

The individual solid body or functional structural element to be accommodated by the expanding foamed metal can, as expressed above, be entirely surrounded by the foam, whereby the (solid) insert(s) for example provide for a modification of the foam structure. Reinforcing elements for example, such as bars, wires, networks or the like for example, come into consideration for this. However, the foamed metal may also enclose only the anchoring region or the like of a functional structural element, for example a fastening element, the actual functional region extending for example above the surface of the foamed metal body, protruding from it or the like. If metal sheets, that is to say solid bodies with a planar or spatial, but predominantly flat extent are to be joined to the foamed metal, the foamed metal comes to bear in a flat, integrating manner and consequently is integrated flat onto the metal sheet.

A particularly intimate bond between the solid body or plurality of solid bodies and foamed metal can be achieved with a choice of material according to the first embodiment of the invention.

As provided in the case of a second implementational variant of this invention, the individual (solid) body does not have to be produced completely from a metal compatible with the matrix metal of the foamed body which is forming, but rather a coating of the same which promotes material bonding may well suffice, although an integral bond of said coating with the basic body forming its substrate is important.

The invention further comprises as a third variant a selection of materials, material phases, layers or the like coming into consideration for the effective bonding of the (solid) parts into the foamed metal body.

Likewise preferred special cases for the desired high degree of integration of the solid bodies or solid functional structural elements into the foamed metal are respectively shown by the fourth and fifth variants.

In this sense, a number of metals or metal combinations promoting the material bond referred to and specifically directed at the aluminum-based foam matrix metals used to a great extent and with preference are mentioned there as the last variant.

For cases where an intimate bond, as previously dealt with at length, between the foam and the body embedded in the same is not desired, or even subsequent removal of the body is to take place, the measures brought together in the first implementational variant of the invention may bring advantages.

There are in fact no limits to the techniques for applying the coatings promoting or else inhibiting the material bond between the matrix metal and the solid parts encapsulated in the foam of the same. Accordingly, a number of such coating technologies that are particularly preferred within the scope of the invention are mentioned in the second variant according to the invention.

The material bond, in itself essential and desired for most cases, can be supported in an advantageous way by measures for increasing the mechanical bond between the foamed metal and individual solid bodies, as provided for example by enlarging or specially shaping its surface, as provided according to the third preferred embodiment of the invention.

The solid bodies to be integrated into the foam may be produced for example by casting, continuous casting, extrusion molding, extrusion, rolling or the like. For certain cases, for example if the insert structural elements are to meet particularly high technological requirements, that is to say are to have, for example, a high level of hardness, abrasion resistance, chemical resistance or the like, the use of solid bodies or structural elements of material produced by powder-technological means and compacted, for example sintered, is also possible.

Molding or structural elements to be foam-encapsulated of materials with melting temperatures which lie above the melting temperature of the metal of the basic body to be expanded are preferably used.

A major advantage of the novel process of in situ foaming is provided by the first implementational variant specified in claim 5, which consists in that the structures, bodies or functional structural elements to be integrated onto or into the foam of the matrix metal are introduced into the shaping mold together with foamable semifinished bodies, which have essentially a geometry which is similar to the geometry of the finished composite product obtained after foaming.

The disadvantages and problems occurring when, as described above and previously known, the semifinished product used is already in the form of a material composite when it is to be introduced and then expanded together with the solid elements, for example metal sheets, present in the composite, concerning a specific positioning corresponding to the desired final positioning in the finished composite foamed body, have already being briefly discussed above. The process according to the invention provides the major advantage here that it makes it possible for the first time for the solid parts actually to be finally positioned exactly at the desired locations of the foamed body, in a position which is also exact in terms of the angular and spatial attitude, with a procedure such as that provided according to the second embodiment of claim being of particular advantage.

The invention includes a first preferred process variant in which the retaining elements serving for an exact positioning of the solid parts as it were "go into" the foam matrix, or the like, in other words can be genuinely material-integrated into the same.

To avoid undesired shifting or slipping of the semifinished bodies with respect to one another during the foaming operation, said bodies themselves indeed having to be arranged in the mold before the foaming process quite specifically and preferably in such a way that they match the final form, it has further proven to be particularly favorable to make the semifinished bodies available for the foamed metal formation for instance in the form of mats, bundles or the like held together by metal wires or by filaments of material which is soluble in the matrix metal or for example combustible with essentially no residue; see in this respect the second variant of claim 6, it then just being necessary to follow a procedure in which the mats can be cut to the appropriate length and possibly also width, and the pieces of mat contoured in this way can be introduced directly into the mold, whereby the risk of the semifinished bodies shifting with respect to one another no longer exists. At locations of relatively great foam height, a correspondingly shaped second mat may be arranged on the first mat, etc.

Retaining elements, whatever form they take, with a higher melting temperature than that of the matrix metal forming the foam are preferred.

If it is intended to produce particularly robust sandwich foamed metal bodies with metal sheets or foils respectively bounding the foamed metal bodies above and below or on both sides, which lends the molding particularly high mechanical stability, it is favorable to arrange in the foaming and shaping mold foils and/or metal sheets of this type at the corresponding locations of the in the desired position. This provides the advantage that, for example, an "upper" covering foil or a coverage sheet of this type is not arranged, as previously, directly on the body of compacted metal matrix/foaming agent semifinished product arranged on the first sheet, this sheet or foil then being lifted by the foamed metal itself, with increasing pore formation and pore volume enlargement, during the development of the foam, and finally pressed against the top of the mold. Rather, this upper covering foil or upper covering sheet is arranged right away such that it is in the proximity, of, or bears against, the top of the mold, for example by means of appropriate foil holders, so that the aimed for welding with the foamed metal reaching it during the foaming process takes place right away in the desired, exact position.

To obtain a solid body/foamed metal composite molding that is virtually optimum, requires a minimum of finishing effort and is in the final form and final dimension, the charging of the foaming and shaping mold adjusted to match the final form is particularly favorable. In the way specified there, integral foam structural elements of the novel type with largely homogeneous pores can be achieved.

For the production of foamed-metal moldings having pore fractions, pore densities or pore volumes varying locally in regions of their volume, the type of mold charging with the bodies of the foamable semifinished product provided according to the second variant of this claim brings advantages.

For achieving moldings with optimum bonding-in of the solid bodies, it has proven to be particularly advantageous to maintain ratios between the volumes or the total volume of the compacted, foamable semifinished bodies introduced into the mold and the cavity of the shaping mold.

The invention is not in any way restricted to "full" solid bodies, but rather the incorporation of hollow solid bodies, that is to say bodies which are hollow but virtually solid surrounding walls, may also be provided.

A further advantageous possibility consists in that foamed metal bodies are created with clearances, cavities or the like which are accessible from the outside or, for example, also pass through them, which on the one hand saves such empty spaces from subsequently being introduced, but on the other hand has the advantage that the hollow bodies forming the limitation of the empty spaces there provide a significant mechanical reinforcement together with the foamed metal surrounding and integrating them. For example, straight tubular bodies from one wall to the opposite wall of the mold can be foam-encapsulated there tight or, for example, bent tubular bodies from one wall to a neighboring wall of the mold.

In order on the one hand to allow for as high a surface area as possible for the contact of the foamable compacted semifinished material with the mold or mold base provided for heating up, shaping and dimensioning the latter, and on the other hand to avoid undesired slipping or uncontrolled rolling away of the semifinished bodies during manipulation of the mold, and consequently irregular or undesired material density distribution in the mold before foaming, it is favorable according to a third variant of claim 9 to provide a semifinished material with bodies with at least one flat or planar resting side, that is to say underside, by which these semifinished bodies rest on the mold base or a composite metal sheet placed in said mold.

Finally, the invention relates to the composite foamed bodies produced by the novel process.

To sum up, the following is consequently to be stated:

As already mentioned, according to the invention a foamable semifinished product obtained by powder-metallurgical production means is used. The starting product for the production of aluminum foam moldings is, for example, a powder mixture of aluminum or an aluminum alloy, homogeneously mixed with a foaming agent—preferably titanium hydride—and possibly further powder-like additives, which is compacted on a compacting installation, for example a CONFORM system, by pressing, extruding, rolling or in a comparable way, to form piece goods, that is to say bars, plates, profiles or similar semifinished forms, a density of the semifinished product obtainable in this way which preferably lies above approximately 95% of the theoretical density of the metal matrix usually being achieved.

There are known sandwich plates with covering metal sheets, foils or the like applied on one or both sides which have been clad by roll-bonding in a first step, in order finally to join these covering sheets metallically to the metal matrix of the foamable semifinished product, possibly to contour this laminar structure and then, by heating to the melting temperature of the foamable semifinished product, form the foamed body, which is then finally bonded with a material-integrally to the metallic covering sheets; see in this respect, for example, DE 196 12 781 C1.

The following are among the disadvantages of the previously known processes:

a) The roll-bonding cladding just briefly described presupposes that the foamable semifinished product is also available from the outset in plate or sheet form. Such sheet production by powder-metallurgical means is difficult. Known technologies which are available are powder rolling, which however has not so far been successfully developed to the production stage in conjunction with an foamable semifinished product, along with extrusion molding. In extrusion molding, however, there are relatively narrow limits to the profile width, determined by the inside width of the recipient. If an extrusion-molded profile is rolled in the longitudinal direction, the widening of the same produced as a result is inconsiderable. If greater sheet widths are required, the extrusion-molded profile must be cut to length and then introduced transversely into the rolling nip. The production of relatively large amounts of composite plates by transverse rolling is usually rejected, however, by the rolling mills for safety reasons.

b) Structural elements with covering sheets applied on both sides may be either smooth on both sides or they have, for example, contours which are the same as one another on both sides.

c) On sandwich structural elements with covering sheets arranged on both sides, which after roll-bonding cladding and before foaming have "angular" contours or cross sections, for example similar to a flat U with lugs protruding away at an angle on both sides, somewhat like this: ⊔, the part of the foamable semifinished product in the vertical position cannot expand horizontally. The wall thickness of the foam core is therefore greater in the horizontal positions and less in the vertical positions after expansion. The roll-bonding-clad semifinished product of this type, that is to say a sandwich composite, with contours, can be used only for limited geometries and sizes. With increasing thickness of the expanded structural element, the geometry of the lower and upper covering sheets changes significantly. The semifinished product rolled in between the covering sheets cannot adapt to these changes.

A number of significant points and preferred variants of the process according to the invention are now globally summarized as follows:

1. Covering sheets and foamable semifinished bodies in bar, profile or similar form are placed adjacent to each other and one above each other in a foaming and shaping mold.
2. An upper covering sheet to be integrally bonded to the foamed metal, and a lower covering sheet of this type, may have forms, cross-sectional shapes or topographies which are different from one another without any problem.
3. Foamed sandwich plates can be produced by placing underlying and covering sheets, foils or the like into the mold, without the preparatory or intermediate step of roll-bonding cladding or compacting to form a composite semifinished product, that is to say virtually in one operation.
4. In the case of sandwich foamed metal sheets, the covering sheets consist for example of aluminum or other metals, such as for example steel, Ni-based alloys and their alloys, the melting point of which is for example at least 50° C. above the melting point of the semifinished product or matrix metal to be expanded.
5. The foamable semifinished product is preferably formed by profiles produced in a "CONFORM" or extrusion-molding installation, preferably with flat or round dimensions, the cross section of which can be adapted overall to the cavity of the mold in such a way that a plurality of profiles are placed adjacent to another or one above each other, the amount, degree of filling and filling height being governed by the desired and aimed for density of the foamed metal structural element respectively to be produced.
6. Foamable semifinished bodies with the same dimensions can be used for different structural elements and different densities and thicknesses. Locally different properties can be achieved in the finished structural element by arrangement of these semifinished inserts at locally different proximities to one another. At the limits between the semifinished bodies or profiles originally is placed into the mold, patterns are produced on the finished foamed metal body or on the surface of the latter and can be used for decorative purposes.
7. To secure adjacent semifinished profiles in the mold against shifting or slipping, it is favorable to use either profiles with at least one flat resting surface, or else profiles or bars to be positioned adjacent to another, or else profiles or bars to be positioned next to one another are joined with the aid of thin metal wires or fibers of various origin, which for example burn without any residue—apart from gas formation—decompose or are dissolved in the molten foamed metal during the foaming operation, to form mats with, for example, uniform distances between the bars, which mats may be prefabricated and precontoured—which significantly simplifies the charging of the mold—when they are placed flat into the mold or locally in layers.
8. The profile cross section of the foamable semifinished product and the position of the bodies to be formed within the mold is advantageously chosen in such a way that the oxide skin located on the surface of the semifinished bodies has sufficient space to break open during the foaming operation, in which the semifinished product of course is initially inflated, so that the nonoxidized metal of the foamed body, liquid in this state, can bond metallically overall to form the foamed body without troublesome oxide skins.
9. The original position of the semifinished bodies used can be seen on the finished plate at its surface and the boundary surfaces between the semifinished bodies, set off in their structure or appearance, can be used as a design element.
10. In the production of sandwich foamed metal plates or the like, the foamed metal is diffusion-welded with a solid covering sheet, previously not yet heated up to the melting temperature, by the effect of the is molten foam front. To improve the metallic bond between the foamed body and the covering sheet or the like, the covering sheet may be clad by rollbonding or coated either with a low-melting alloy, for example $AlSi_{12}$, or with a diffusion-promoting agent, for example zinc. If an intimate bond between the foamed metal and the covering sheet is not desired, release agents, such as for example graphite, an eloxal layer or the like, are favorably applied there.
11. According to an important production variant, the upper covering sheet may be arranged such that it bears against the upper half or top of the mold, or for example is pressed against it, with the aid of spacers or the like, or it is clamped onto it. It can consequently be ensured that the upper covering sheet is already in its final position during the foaming operation and does not first have to be raised by the front of the expanding foam and, as this happens, become for example incorrectly arranged, tilted or the like and is consequently not in the desired final position in the finished foamed body.

Everything stated so far with respect to metal sheets applies analogously to all other forms of structural elements, structures, solid bodies and the like to be integrated into or onto the foamed metal.

An extremely wide variety of integral foam moldings can be produced by the process described above:

i. Plates and sandwich plates which have covering sheets on one side or two sides or have no covering sheets, are plane-parallel or contoured and moldings with covering surface topographies differing from one another.
ii. Moldings of which the hollow interior is "stiffened" with foamed metal.
iii. Upper and lower covering sheets ultimately joined to the foam may be differently contoured, that is to say f or example on the upper side the foamed metal/solid-part composite body may have a corrugated-sheet contour and on the underside it may, for example, be smooth or be provided with a corrugated sheet of some other contour.

iv. By means of semifinished inserts of different densities and the same or different dimensions from one another, different foam thicknesses can be achieved with the same or constant density and (locally) different densities with (locally) different foam thicknesses.

v. For further weight savings, local clearances can be formed in a foam plate to be produced by means of inserts, for example with cavities, that is to say for example pieces of tube, between the covering sheets.

vi. Foamed bodies and end-plate sheets, foils or the like may optionally be securely joined metallically to one another or optionally not be joined to the foamed metal at all or joined in some locations.

vii. An extremely wide variety of solid metal parts, such as tubes and fastening elements, heat exchanging or cooling elements or the like, may be incorporated into the foamed body during foaming.

viii. Foam plates, surrounded by edge strips or covering sheets integrated on one or both sides can be produced. In this case, the peripheral side edges may be formed for example with a channel, produced with the aid of a two-part frame. After the foaming operation, the surrounding frame is swung open and removed. A solid aluminum profile is jammed or adhesively bonded or screwed into the channel produced. The solid profile overlaps with its members the edge of the foam plate and consequently allows a neat formation of the plate edge. This solid-profile frame may also be designed as a connecting piece of two or more is plates joined together at the butt joint, whereby large-area plate structures can also be produced.

A channel provided on the outer sides of the members of the solid aluminum profile can accommodate the edge of a covering sheet, which is pushed into the channel with its edge at right angles. The connection between the covering sheet edge and the solid aluminum profile may be established by adhesive bonding or soldering, welding or else other joining techniques.

DETAILED DESCRIPTION OF THE DRAWINGS

The invention is explained in more detail with reference to the drawing.

DETAILED DESCRIPTION

Figure 1:
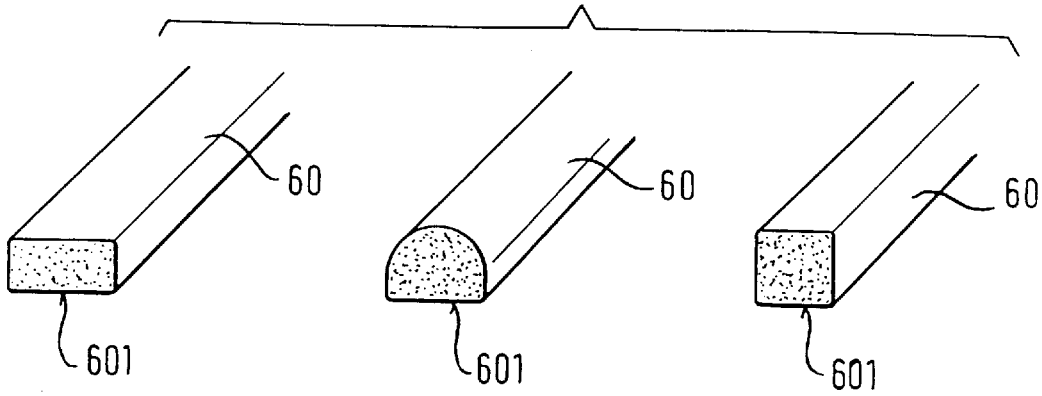
FIG. 1 shows particularly preferred forms of profiles of the foamable semifinished product to be used, produced by compacting metal powder and foaming-agent powder.

FIG. 1 shows in an oblique view three forms of foamable semifinished bodies 60 to be used according to the invention which are particularly preferred within the scope of the present invention, to be precise one with a flat rectangular cross section, one with a more than semicircular cross section and one with a square cross section. At least one of the side faces, denoted in the drawings by 601, is essentially planar and flat, the other faces may have any shape, that is to say be for example convexly curved or formed in some other way. An advantage of the planar faces 601 is that the semifinished bodies 60 can bear with large surface-area contact against the base of a mold or against a sandwich sheet fitted in said mold, the risk of locational displacement or slipping during movement or manipulation of the mold being significantly reduced. A further major advantage is that an improvement in the heat transfer from the mold base into the semifinished product 60 is also achieved by this planar face 601.

Figure 2:
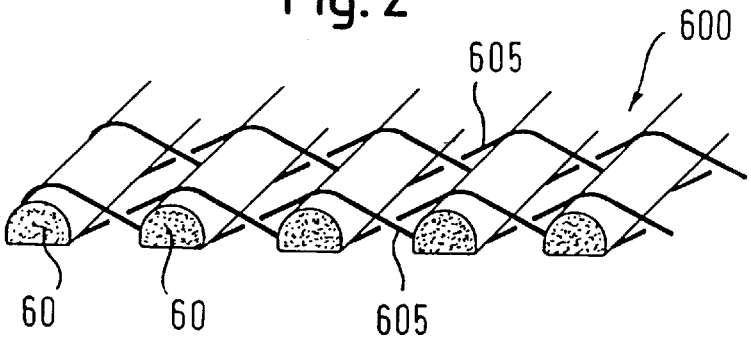
FIG. 2 shows the diagram of a mat formed with said semifinished bodies.

FIG. 2 shows a further, particularly preferred possibility for preventing undesired shifting of the semifinished bodies 60 both in the mold and with respect to one another. It is shown in a sectional view how the semifinished bodies 60 have been woven, with here, too, a flat underside 601, by means of filaments, wires 605 or the like, for example of the same material as the matrix metal to be foamed, to form a type of mat 600, which contributes significantly to the stabilizing of the arrangement in the mold.

Figure 3:
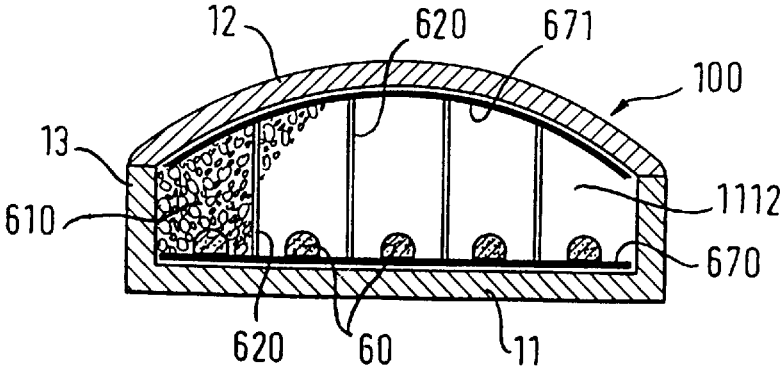
FIG. 3 shows a diagram of a mold charged in a suitable way for carrying out the process according to the invention.

FIG. 3 shows in a diagrammatically schematic form an inner space 1112 of a foaming and shaping mold 100 advantageously charged within the scope of the invention: lying on the—here flat—mold base 11 is a lower solid bottom sheet 670 for the formation of a foamed metal/solid metal composite body, on which semifinished bodies 60 based on extrusion-molded compacts of a metal powder, for example Al powder, and a foaming-agent powder, for example TiH powder, are arranged with their flat sides 601, then forming the matrix foamed metal when the foaming temperature is reached. A curved composite sheet 671, which is ultimately welded material-integrally with the matrix foamed metal 610 expanding when the mold 100 is heated, is held in position against the concavely curved top 12 of the mold by means of the supporting bodies 620, supporting themselves from below, for example hollow cylinders or the like, advantageously of a metal which can be solubilized from the foamed metal or breaks up in it and melts at a somewhat higher temperature.

In order, for example, as FIG. 3 shows, to load a lower sandwich sheet 670, arranged on the base of a mold 100, with the semifinished bodies 60, all that is necessary, for example, is to cut to length or contour in each case flat pieces of the semifinished mat 600 explained above, shown in FIG. 2, and define the base area of the future foamed body with them arranged, for example, against one another or else partly one above the other. The retaining wires 605 may be produced from metal compatible with the matrix metal or else from a material which burns, decomposes or can be destroyed in some other way at the heating and foaming temperature to be reached.

What is claimed is:

1. A process for producing a molded shaped article comprising a foamed metal body having at least one non-foamable functional structural element embedded in the foamed body, comprising the steps of:

(a) providing a hollow mold;

(b) placing in the hollow mold (1) a foamable material comprising a metal and a foaming agent and (2) a functional structural element;

(c) heating the mold to a temperature sufficient to foam the foamable material so that it expands and fills the hollow mold;

(d) cooling the mold; and (e) demolding the shaped article comprising a foamed metal body having at least one functional structural element embedded therein.

2. A process according to claim 1, wherein the hollow mold defines an internal surface and the process further includes the steps of:

(a) locating and supporting at least one non-foamable functional structural element on the internal surface of the mold with consumable retaining elements; and (b) consuming the retaining elements during the heating of the mold.

* * * * *